US007303458B1

(12) United States Patent
Wolfinbarger

(10) Patent No.: US 7,303,458 B1
(45) Date of Patent: Dec. 4, 2007

(54) HOOP WITH WEIGHTED MEMBER

(75) Inventor: Ryan Wolfinbarger, Avon, IN (US)

(73) Assignee: Fundex Games, Ltd., Indianapolis, IN (US)

( * ) Notice: Subject to any disclaimer, the term of this patent is extended or adjusted under 35 U.S.C. 154(b) by 174 days.

(21) Appl. No.: 11/150,569

(22) Filed: Jun. 10, 2005

(51) Int. Cl.
*A63H 33/30* (2006.01)

(52) U.S. Cl. ..... 446/236; 446/26; 446/28; 482/131; 601/132

(58) Field of Classification Search ..... 446/236; 482/131; 601/132
See application file for complete search history.

(56) References Cited

U.S. PATENT DOCUMENTS 3,190,032 A * 6/1965 Green et al. ..... 446/213
3,509,660 A * 5/1970 Seymour ..... 446/38
4,526,371 A * 7/1985 Venditti ..... 273/148 R
4,915,666 A * 4/1990 Maleyko ..... 446/242
5,338,244 A * 8/1994 Huang ..... 446/242
6,379,288 B1 * 4/2002 Liu ..... 482/105
6,450,854 B1 * 9/2002 Fireman et al. ..... 446/236
6,482,136 B1 * 11/2002 Kessler ..... 446/236
6,814,645 B2 * 11/2004 Kuk ..... 446/236

FOREIGN PATENT DOCUMENTS

WO WO 9412242 A1 * 6/1994

* cited by examiner

*Primary Examiner*—Eugene Kim
*Assistant Examiner*—Urszula M Cegielnik
(74) *Attorney, Agent, or Firm*—Adam K. Sacharoff; Much Shelist

(57) ABSTRACT

In accordance with one embodiment of the present invention there is provided a hoop having an inner circumference that generally forms a circle with an inner diameter sufficient to receive portion of a human body therethrough. A weighted member is slidably secured onto the hoop to increase a centrifugal force of the hoop when in use. The weighted member has a central body with two ends diametrically opposed and has a hollow channel aligned with the two ends. The two ends being sized to slide over the hoop. Bushings may be inserted into the two ends to reduce friction.

3 Claims, 7 Drawing Sheets

HOOP WITH WEIGHTED MEMBER

FIELD OF THE INVENTION

The present invention relates to a hoop, and more particularly, to a hoop consisting of a weight member being installed on the hoop, wherein when a user spins the hoop around their waist, the weight member increases a centrifugal force of the hoop making spinning the hoop easier.

BACKGROUND OF THE INVENTION

Hoops have been used for a number of years to provide entertainment and enjoyment to individuals of all ages. Such products typically incorporate a circular, single piece plastic hoop having a pair of terminal end portions. The end portions may be coupled together in a variety of ways to hold the free ends of the hoop together. Unfortunately, as people today become less active and heavier the ability to enjoy hoops decline. This is due mainly because the ability to gain momentum and spin the hoop around the body becomes harder. As such a need exists to make hoops easier to use. For example, the ability to provide a hoop that includes a weighted member to assist in making the use of the product easier.

SUMMARY OF THE INVENTION

In one embodiment of the present invention there is provided a hoop having an inner circumference that generally forms a circle with an inner diameter sufficient to receive portion of a human body therethrough. A weighted member is slidably secured onto the hoop to increase a centrifugal force of the hoop when in use. The weighted member has a central body with two ends diametrically opposed and has a hollow channel aligned with the two ends. The two ends being sized to slide over the hoop. Bushings may be inserted into the two ends to reduce friction.

In another aspect of the present invention the hoop includes a pair of terminal ends that are sized to receive ends of a connector. A male/female adapter is used for securing the connecter to the terminal ends of the hoop.

In yet another aspect of the present invention the hoop is D-shaped with an outer circumference that is substantially flat. A recess region is provided in the flat outer circumference that is sized to receive a pre-printed label.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein:

FIG. 9 is a perspective view of the D-shaped hoop illustrated the attachment of a pre-printed label;

DETAILED DESCRIPTION OF THE DRAWINGS

Figure 2:
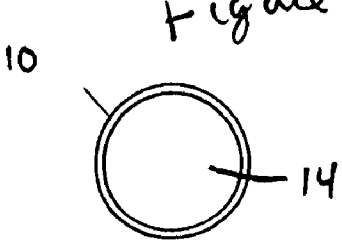
FIG. 2 is a cross sectional view of the hoop from FIG. 1.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Figure 1:
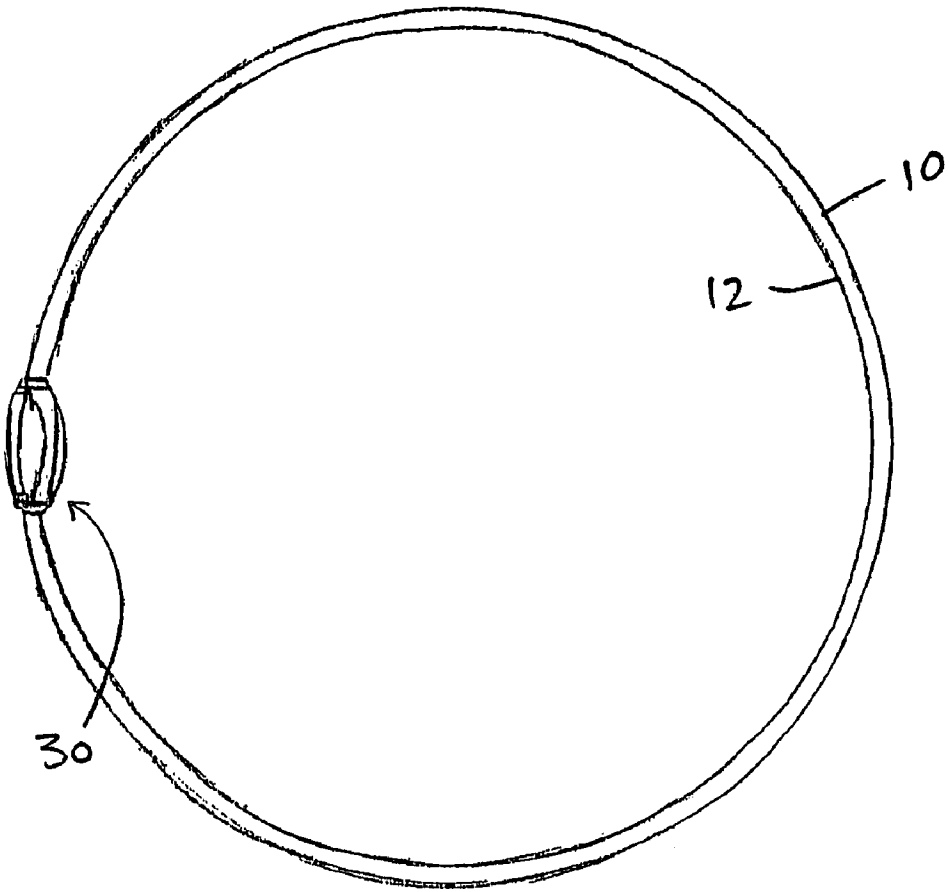
FIG. 1 is a side view of a circular cross sectional hoop with a weighted member in accordance to an embodiment of the present invention.
Figure 4:
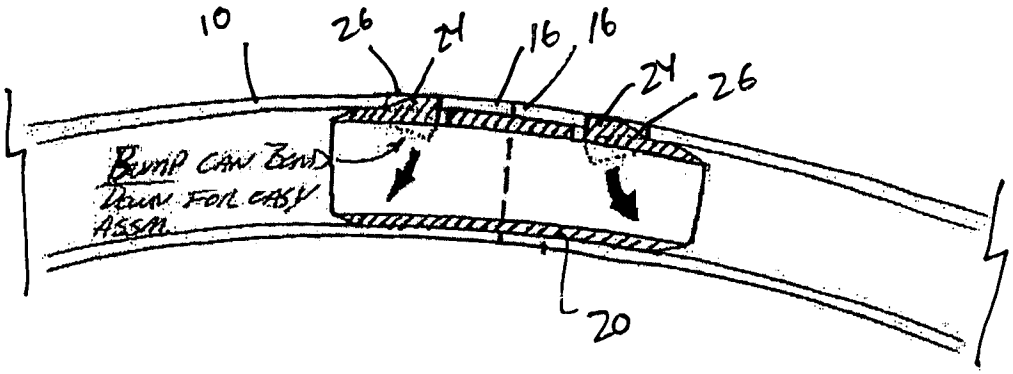
FIG. 4 is a cross sectional view of the terminal ends and connecter assembled from FIG. 3.
Figure 3:
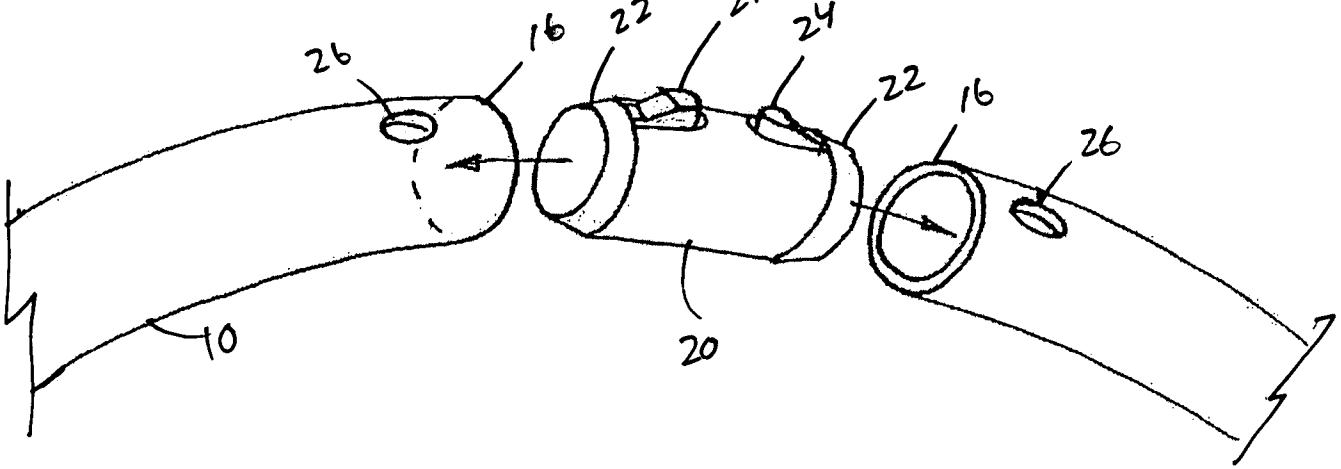
FIG. 3 is a perspective view of the terminal ends of the hoop from FIG. 1 which are secured to a connector.

Referring now to FIG. 1, a hoop is illustrated and generally referenced to numeral 10. The hoop 10 may include various cross sectional configurations. In this first embodiment, the cross section is generally circular (FIG. 2). The hoop 10 is thereby provided with an inner circumference 12 that generally forms a circle (FIG. 1). The hoop 10 has an inner diameter sufficient to receive a portion of a human body therethrough. The hoop 10 may also have a hollow cavity 14 (FIG. 2). Referring now also to FIGS. 3 and 4, the hoop 10 includes two terminal ends 16. Each terminal end 16 is secured to one another by a connecter 20. As illustrated, the connecter 20 includes opposite ends 22 that fit within the hollow terminal ends 16. Each end 22 of the connecter 20 includes a projecting resilient member 24 that is sized to fit within apertures 26 defined on the terminal ends 16.

It being well known in the art of end connecting, that any type of male/female adapters can be used within deviating from the scope of the invention. In addition, the connector 20 can be made with hollow ends sized to fit over the terminal ends of the hoop. In such an embodiment, the terminal ends of the hoop may include male adapters sized to fit within female receivers on the connector.

Figure 5:
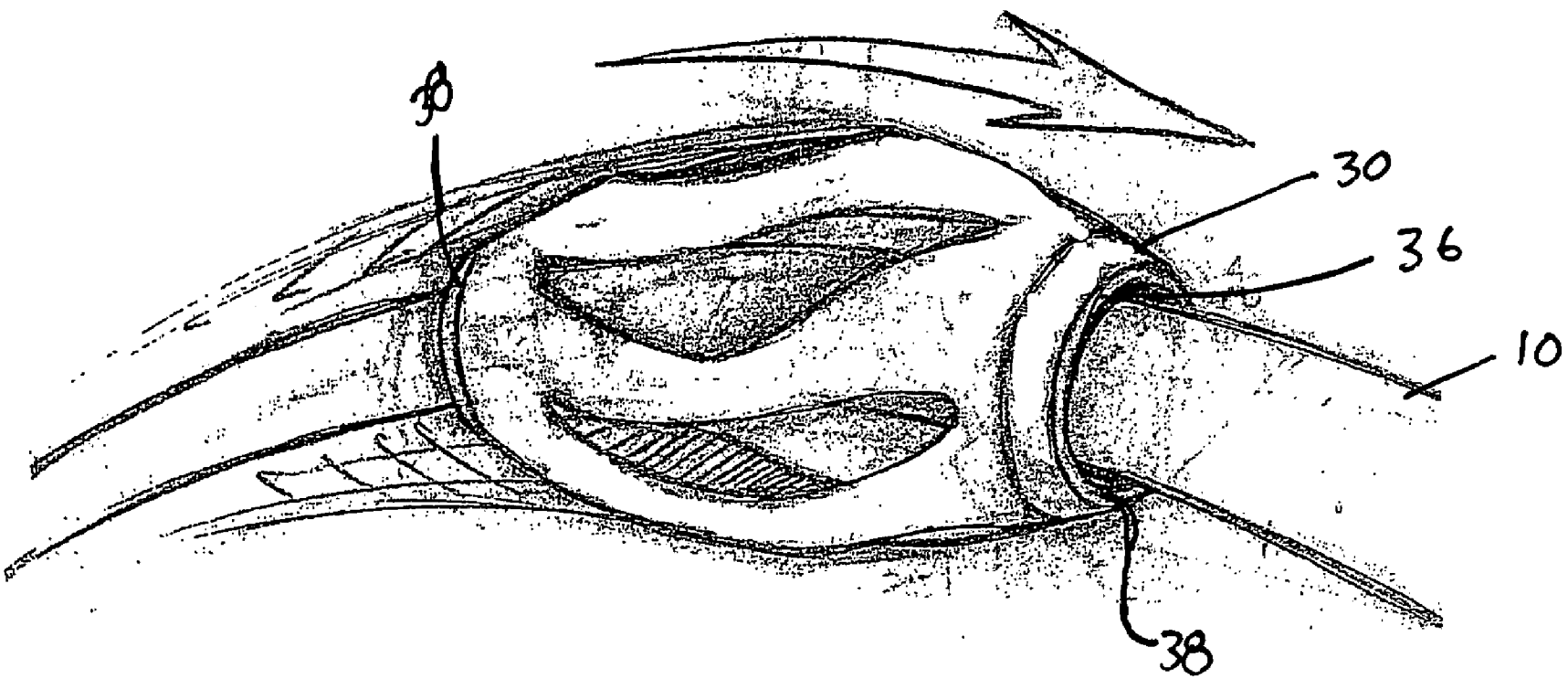
FIG. 5 is a perspective view of a weighted end applied over the hoop from FIG. 1.
Figure 6:
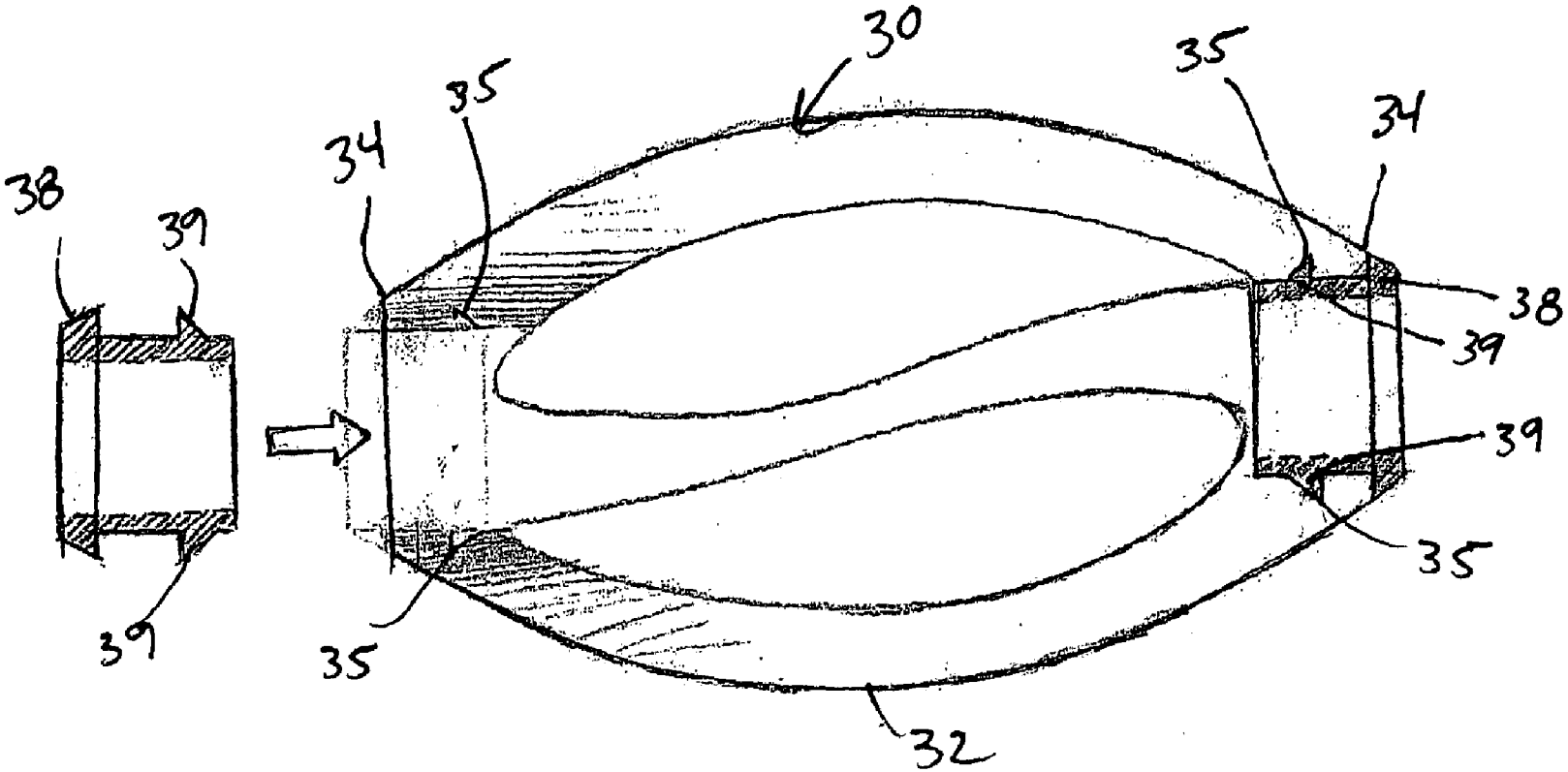
FIG. 6 is a cross sectional view of the weighted end from FIG. 5.

Referring now to FIGS. 1, 5, and 6, the hoop 10 is provided with a weighted member 30 that freely moves around the hoop 10. The weighted member 30 is composed of a central body 32 with two ends 34 diametrically opposed. The central body 32 includes an hollow internal channel 36 that is aligned with the two ends 34 of the central body 32. The ends 34 of the central body 32 include grooves 35. Fitted within the two ends 34 are bushings 38. The bushings 38 include projections 39 extending outwardly therefrom to fit within the grooves 35 defined on the ends 34. The bushings 38 are thus secured to the ends 34 of the central body 32. The bushings 38 are also bored therethrough such that the hoop 10 may slide through the bushings 38 and through the weighted member 30. The bushings 38 may be further designed to reduce friction against the hoop 10, this may be accomplished by making the bushings 38 out of a material that has a low coefficient of friction. When attached to the hoop 10, the bushings 38 are the only structure of the weighted member 30 that comes in contact with the hoop 10.

When using the hoop by rotating the hoop about the body of a user at some speed, the weighted member 30 is apt to centrifugally move about within the hoop 10 in a direction opposite to the direction of rotation of the hoop 10, and to centrifugally add a force tangentially to the direction of the moving hoop that is continuously rotated about the user. The increase in centrifugal force helps increase the rotational speed of the hoop 10 with less action put forth by the user. As such the user can maintain a rotating hoop 10 with less energy and force.

Figure 8:
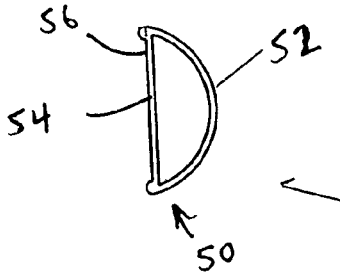
FIG. 8 is a cross sectional view of FIG. 7.
Figure 7:
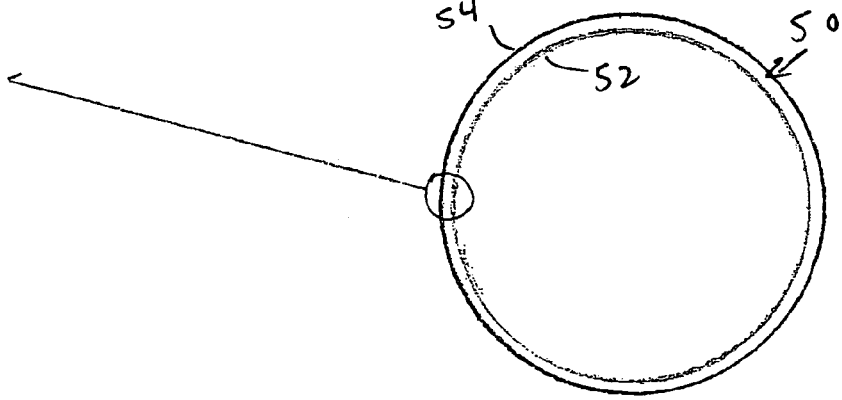
FIG. 7 is a side view of a D-shaped cross sectional hoop.
Figure 6:
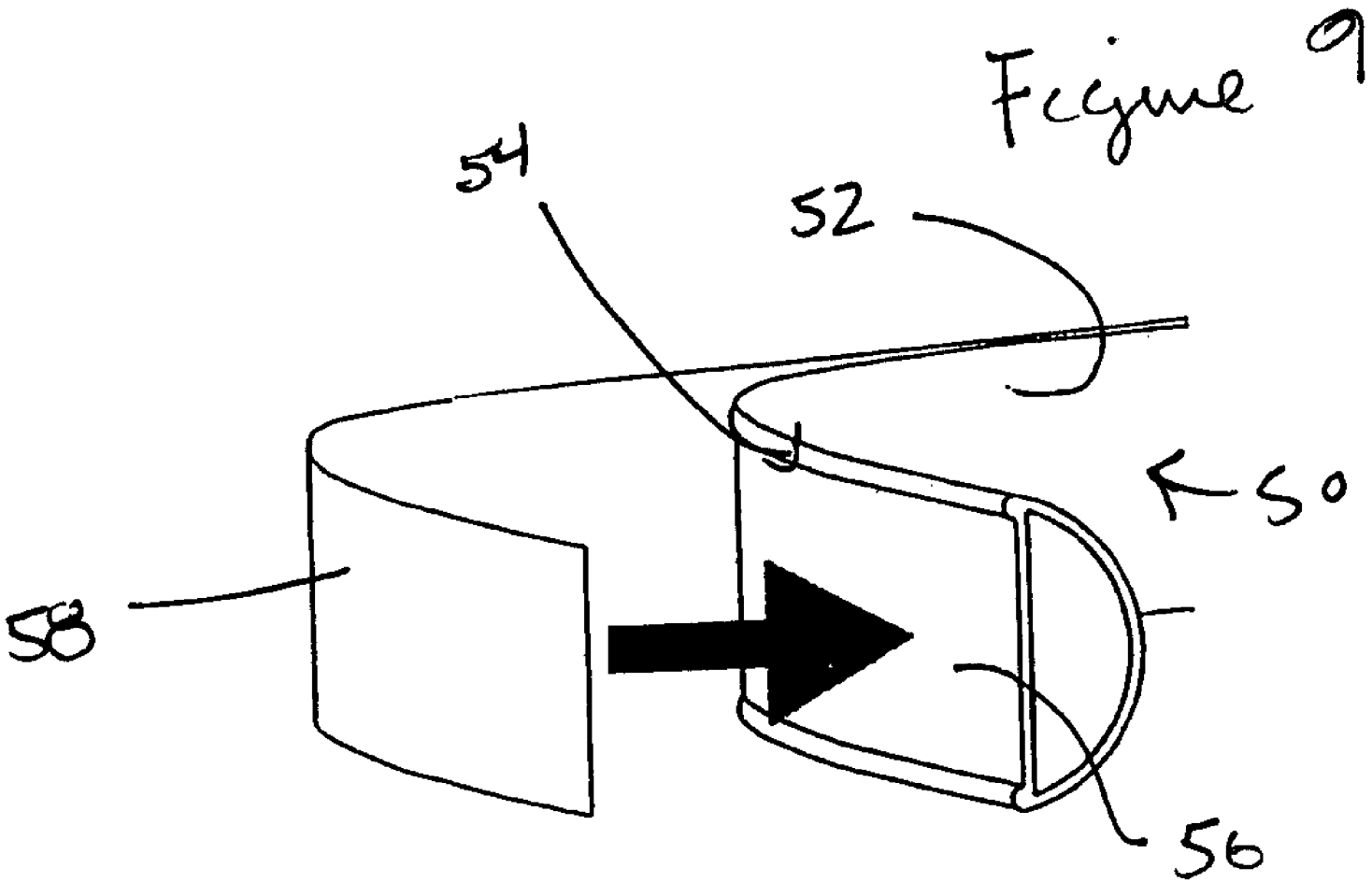

In a second aspect of the present invention, referring now to FIGS. 7 through 9, a hoop 50 is provided as described above except that its cross sectional shape is substantially D-shaped. The hoop 50 is thereby provided with an inner circumference 52 that generally forms a circle (FIG. 7) and an outer circumference 54 that is substantially flat. The outer circumference 54 also includes a recessed region 56 that can accommodate a pre-printed label 58. The pre-printed label 58 is affixed to the recessed region 56 by any well known adhesive.

Figure 10:
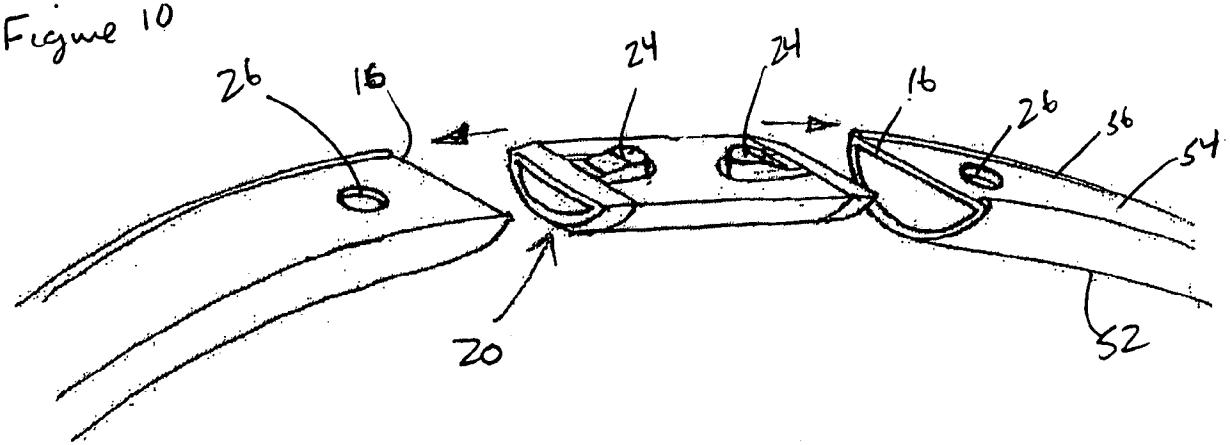
FIG. 10 is a perspective view of the terminal ends of the hoop from FIG. 9 which are secured to a connector.
Figure 11:
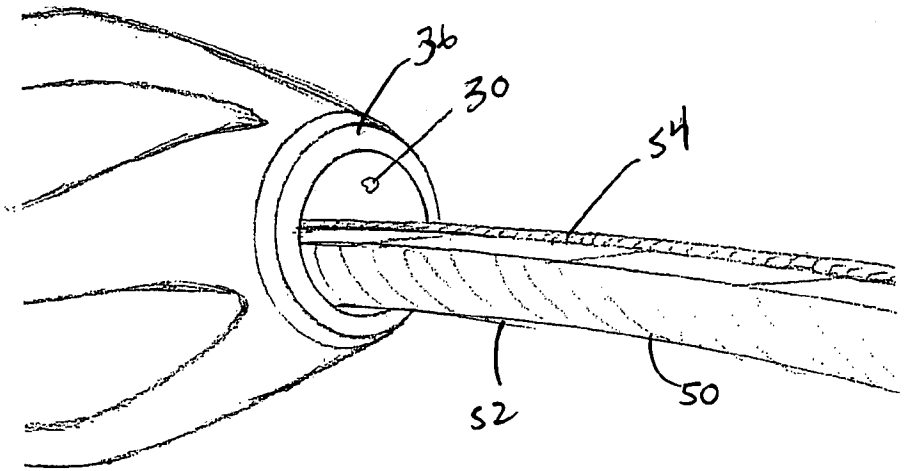
FIG. 11 is a perspective view of the weighted end from FIG. 6 applied over the hoop from FIG. 9.

Referring now to FIGS. 10 and 11, the D-shaped hoop 50 includes terminal ends 16 and a connector 20 similarly configured to the above embodiment. The weighted member 30 is also easily fitted onto to D-shaped hoop 50.

It is to be understood that no limitation with respect to the embodiments illustrated herein is intended or should be inferred. It is intended to cover, by the appended claims, all such modifications within the scope of the appended claims.

I claim:

1. A hoop comprising:

a hoop having an inner circumference that generally forms a circle and having an inner diameter sufficient to receive portion of a human body therethrough; and a sliding member positioned on the hoop, wherein the sliding member has a central body with two ends diametrically opposed, the two ends being sized to freely slide over the hoop, the central body includes a plurality of elongated elements connecting the two ends, each elongated element being spaced apart from another elongated element to create openings through the central body such that the hoop is visible through the openings as the sliding member freely slides over the hoop.

2. The hoop of claim 1 further comprising a pair of bushings separately secured to the ends of the central body, each bushing having a bore therethrough for receiving the hoop.

3. The hoop of claim 1 further including:

a pair of terminal ends defined by the hoop; and a connecter having two ends sized to accommodate the terminal ends of the hoop; and male/female adapter means for securing the connecter to the terminal ends of the hoop.

* * * * *